US007209159B2

(12) United States Patent
Hamano et al.

(10) Patent No.: US 7,209,159 B2
(45) Date of Patent: Apr. 24, 2007

(54) IMAGE FORMING APPARATUS AND IMAGE FORMING CONTROL METHOD

(75) Inventors: Shigemichi Hamano, Chiba (JP); Hideyuki Nagata, Ibaraki (JP); Akihiko Sato, Chiba (JP); Toru Ono, Ibaraki (JP); Yushi Oka, Chiba (JP)

(73) Assignee: Canon Kabushiki Kaisha (JP)

( * ) Notice: Subject to any disclaimer, the term of this patent is extended or adjusted under 35 U.S.C. 154(b) by 416 days.

(21) Appl. No.: 10/774,627

(22) Filed: Feb. 9, 2004

(65) Prior Publication Data

US 2004/0155955 A1 Aug. 12, 2004

(30) Foreign Application Priority Data

Feb. 7, 2003 (JP) ..... 2003-031122

(51) Int. Cl.
*B41J 2/435* (2006.01)

(52) U.S. Cl. ..... 347/249; 347/248

(58) Field of Classification Search ..... 347/224–264; 399/66, 159, 162, 302–303, 308
See application file for complete search history.

(56) References Cited

U.S. PATENT DOCUMENTS

| | | | | |
|---|---|---|---|---|
| 5,499,092 | A * | 3/1996 | Sasaki | 399/302 |
| 6,263,174 | B1 * | 7/2001 | Fuchiwaki et al. | 399/82 |
| 6,275,281 | B1 * | 8/2001 | Nozaki | 355/35 |
| 6,788,322 | B2 * | 9/2004 | Morita | 347/139 |
| 2003/0095173 | A1 * | 5/2003 | Toyoda | 347/116 |
| 2004/0184827 | A1 * | 9/2004 | Yamada | 399/44 |

FOREIGN PATENT DOCUMENTS

| | | | |
|---|---|---|---|
| JP | 5-216323 | A | 8/1993 |
| JP | 6-167842 | A | 6/1994 |
| JP | 7-36249 | A | 2/1995 |
| JP | 7-140845 | A | 6/1995 |
| JP | 10020614 | A * | 1/1998 |
| JP | 11-15290 | A | 1/1999 |
| JP | 2001-075329 | A | 3/2001 |
| JP | 2001-228675 | A | 8/2001 |

* cited by examiner

*Primary Examiner*—Hai Pham
*Assistant Examiner*—Kainoa Wright
(74) *Attorney, Agent, or Firm*—Rossi, Kimms & McDowell LLP

(57) ABSTRACT

An image forming apparatus that is capable of carrying out image formation on a recording medium such as plain paper without increasing the FCOT (First Copy Out Time) and is also capable of carrying out optimal image formation on a recording medium, such as thick paper, for which the processing speed is reduced with no registration misalignment between the leading ends of toner images and the leading end of the recording medium. An image is primarily transferred onto a rotatively driven image carrier, and the image on the image carrier is secondarily transferred onto a recording medium. An image writing reference position signal for starting image formation is issued based on the circumference of the image carrier which is the length of the image carrier in the direction of rotation thereof or based on a detected reference position on the image carrier. A user can selectively switch, through operation of an operating section, between the issuing of the image writing reference position signal based on the circumference of the image carrier and the issuing of the image writing reference position signal based on the detected reference position.

4 Claims, 9 Drawing Sheets

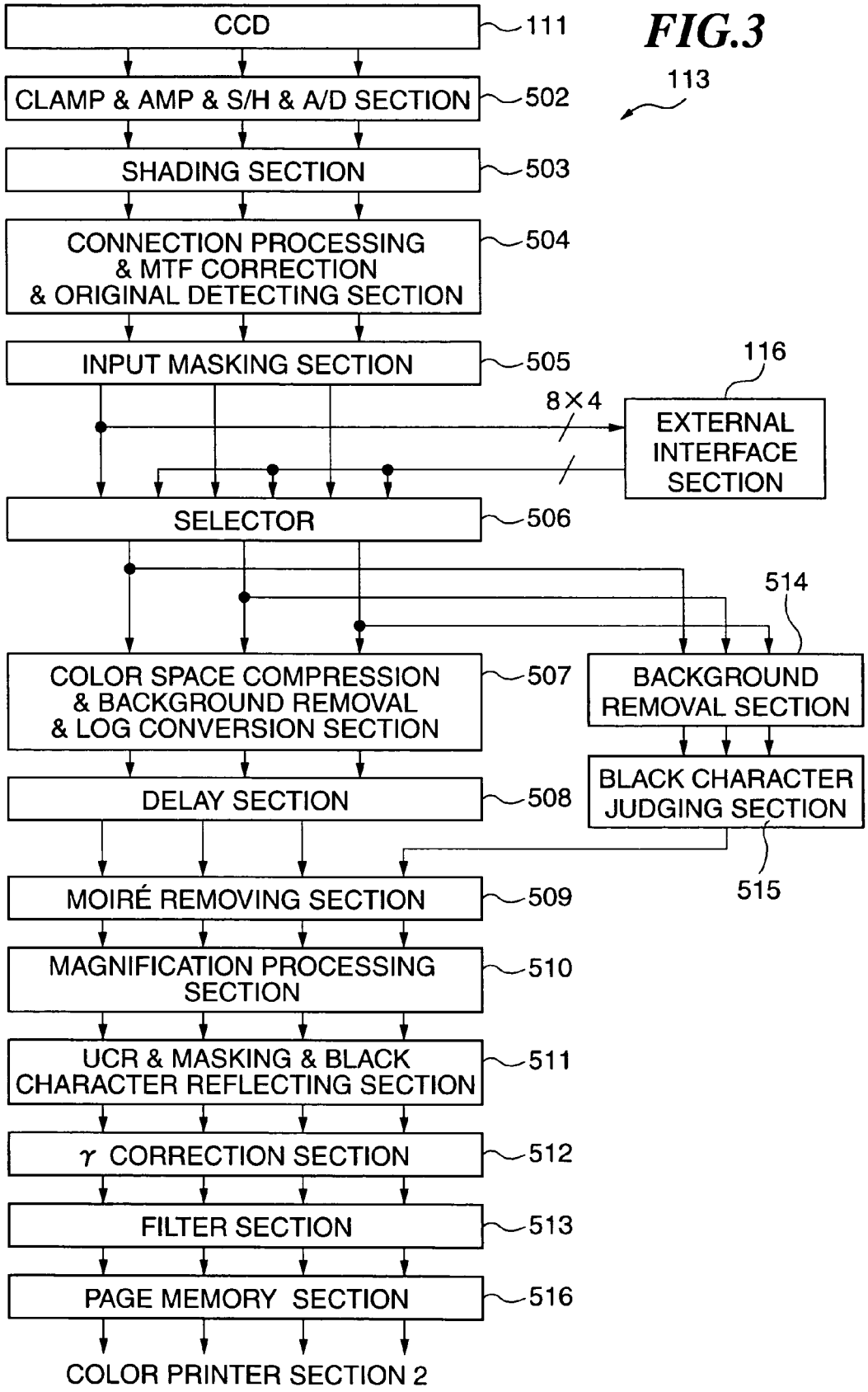
FIG.3
113
CCD
111
CLAMP & AMP & S/H & A/D SECTION
502
SHADING SECTION
503
CONNECTION PROCESSING & MTF CORRECTION & ORIGINAL DETECTING SECTION
504
INPUT MASKING SECTION
505
116
8×4
EXTERNAL INTERFACE SECTION
SELECTOR
506
514
COLOR SPACE COMPRESSION & BACKGROUND REMOVAL & LOG CONVERSION SECTION
507
BACKGROUND REMOVAL SECTION
DELAY SECTION
508
BLACK CHARACTER JUDGING SECTION
515
MOIRÉ REMOVING SECTION
509
MAGNIFICATION PROCESSING SECTION
510
UCR & MASKING & BLACK CHARACTER REFLECTING SECTION
511
γ CORRECTION SECTION
512
FILTER SECTION
513
PAGE MEMORY SECTION
516
COLOR PRINTER SECTION 2

IMAGE FORMING APPARATUS AND IMAGE FORMING CONTROL METHOD

BACKGROUND OF THE INVENTION

1. Field of the Invention

The present invention relates to an image forming apparatus and an image forming control method, and in particular to an image forming apparatus and an image forming control method that carry out full-color image formation by primarily transferring a toner image formed on a photosensitive drum onto an intermediate transfer member and secondarily transferring the toner image on the intermediate transfer member onto a recording medium.

2. Description of the Related Art

Conventionally, there has been known an image forming apparatus that forms a full-color image by forming a latent image on a photosensitive drum according to an electrophotographic method (laser beam method) and developing the latent image by causing toners of respective colors to adhere to the latent image, then primarily transferring the toner images on the photosensitive drum onto an intermediate transfer member and secondarily transferring the toner images on the intermediate transfer member onto a recording medium. An image forming apparatus of this type employs a technique which forms, in carrying out image formation on a recording medium such as thick paper or an OHP sheet, a full-color image by writing toner images of the respective colors (by exposing the photosensitive drum) starting from a reference position on an image carrier (i.e., the photosensitive drum and the intermediate transfer medium) to thereby form the toner images on the image carrier. Japanese Laid-Open Patent Publication (Kokai) No. 05-216323 discloses a technique that, to obtain a sharp image in "OHP mode" or "glossy mode", the processing speed (i.e. rotational speed of the photosensitive drum) is reduced to 1/n without changing the scanning speed of an optical writing means so that optical writing is carried out for only one scanning line out of every n scanning lines, that is, a technique that reduces the processing speed during image formation and carries out image formation for lines that are reduced in number by an amount corresponding to the drop in speed in a subscanning direction during exposure of the photosensitive drum, transfers toner images onto a recording medium, and fixes the toner images.

This technique that carries out image formation for a reduced number of lines can be easily implemented when the reduced processing speed is ½ or ¼ of the normal processing speed, but when the reduced processing speed is ⅓ or ⅔ of the of the normal processing speed, there has been the problem that it is necessary to use complicated hardware circuits of a laser exposure device and the like that carries out exposure processing. To solve this problem, there has been already developed a method that carries out an image forming process for forming images on an image carrier without changing the processing speed but changes the processing speed for carrying out processes including transferring toner images onto a recording medium and subsequent processes (for example, Japanese Laid-Open Patent Publication (Kokai) No. 07-140845).

However, the above prior art has the following problem. That is, when image formation is carried out by the above conventional image forming apparatus on plain paper or a like recording medium without changing the processing speed, in the case where a marking or the like that is formed in advance on an image carrier (intermediate transfer member) is detected and the detected position is used as a reference position (home position) during image writing, there is the problem that image writing cannot be started before the home position is detected. As one solution, it can be envisaged that the image carrier is stopped at a suitable position for subsequent image formation after completion of post-processing (processing such as cleaning off remaining toner from the image carrier) that follows the completion of image formation.

However, when the image carrier (intermediate transfer member) is a belt-shaped member, the image carrier is stretched over a plurality of rollers and rotatively driven, which leads to deterioration of the material of the image carrier due to tension. To avoid such deterioration, it is not possible to stop the image carrier exactly at the same position. Since it is thus not possible to always stop the image carrier at a suitable position following the post-processing mentioned above, time is required to detect the home position, depending on the position of the home position at the start of image formation, and the image formation can be only commenced after waiting for the time required for up to one full rotation of the image carrier at the maximum. This results in that an FCOT (First Copy Out Time) that is a period of time taken from the start of image formation (a process from charging to fixing with exposure, developing, and transferring in between) to discharging of a first recording medium for which image formation has been completed is excessively long.

SUMMARY OF THE INVENTION

It is an object of the present invention to provide an image forming apparatus and an image forming control method that are capable of carrying out image formation on a recording medium such as plain paper without increasing the FCOT (First Copy Out Time) and are also capable of carrying out optimal image formation on a recording medium, such as thick paper, for which the processing speed is reduced with no registration misalignment between the leading ends of toner images and the leading end of the recording medium.

To attain the above object, in a first aspect of the present invention, there is provided an image forming apparatus comprising a rotatively driven image carrier, a primary transfer device that primarily transfers an image onto the image carrier, a secondary transfer device that secondarily transfers the image on the image carrier onto a recording medium, a first issuing device that issues an image writing reference position signal for starting image formation based on a circumference that is a length of the image carrier in a direction of rotation thereof, a second issuing device that issues the image writing reference position signal for starting image formation based on a detected reference position on the image carrier, and a selection device that selectively switches between signal issuing by the first issuing device and signal issuing by the second issuing device.

Preferably, the image forming apparatus comprises a reference position detecting device that detects the reference position on the image carrier by detecting a marking attached to the image carrier, and the first issuing device is operable when image formation is carried out for a plurality of colors, to determine image writing timing for a first color and issue the image writing reference position signal for the first color, and then determine image writing timing for a next color after lapse of a time period corresponding to one rotation of the image carrier later and issue the image writing reference position signal for the next color, and the second issuing device is operable when image formation is carried out for the plurality of colors, to determine the image writing timing for the first color with reference to the reference position of the image carrier detected by the reference position detecting device and issue the image writing reference position signal for the first color, and then determine the image writing timing for the next color with reference to the reference position of the image carrier redetected by the reference position detecting device and issue the image writing reference position signal for the next color.

More preferably, the image forming apparatus comprises a reference clock generating device that generates a reference clock signal, a reference clock counting device that counts time with reference to one period of the reference clock signal as a unit time, a circumference measuring device that measures the circumference of the image carrier based on a time interval counted by the reference clock counting device based on the reference position detected by the reference position detecting device, a storage device that stores the circumference measured by the circumference measuring device, and a line number counting device that counts a number of lines with reference to one period of a laser beam detect signal in a main scanning direction as one line period.

Still more preferably, the reference clock signal has a period corresponding to a time period less than the one line period.

Also preferably, the image forming apparatus comprises a conversion device that converts a count value, which has been counted in units of the reference clock signal by the circumference measuring device, the count value corresponding to the circumference of the image carrier, into a number of lines, and the storage device stores the number of lines converted by the conversion device.

More preferably, the conversion device converts the count value into the number of lines, by finely adjusting an integer part of a conversion result in accordance with a decimal part of the conversion result, and the storage device stores a value of the integer part finely adjusted by the conversion device.

Still more preferably, the storage device stores the number of lines, and the first issuing device causes the line number counting device to count the number of lines stored in the storage device and determines issuing timing of the image writing reference position signal for the next color.

Also preferably, the line number counting device counts a predetermined number of lines corresponding to a time period from issuing of the image writing reference position signal for a final color to restart of conveying for a recording medium from a recording medium standby position located upstream of a position at which image formation is carried out.

Preferably, the selection device selects the signal issuing by the second issuing device when a processing speed at which image formation is carried out is changed during image formation, and selects the signal issuing by the first issuing device when the processing speed is not changed during image formation.

Preferably, the image forming apparatus is an apparatus selected from the group consisting of a copying machine, a printer, and a multifunction apparatus having a combination of functions of a copying machine and a printer.

To attain the above object, in a first aspect of the present invention, there is provided an image forming control method executed by an image forming apparatus that carries out image formation by primarily transferring an image onto a rotatively driven image carrier and then secondarily transferring the image on the image carrier onto a recording medium, comprising a first issuing step of issuing an image writing reference position signal for starting image formation based on a circumference that is a length of the image carrier in a direction of rotation, a second issuing step of issuing the image writing reference position signal for starting image formation based on a detected reference position on the image carrier, and a selection step of selectively switching between signal issuing in the first issuing step and signal issuing in the second issuing step.

Preferably, the image forming control method comprises a reference position detecting step of detecting the reference position on the image carrier by detecting a marking attached to the image carrier, and when image formation is carried out for a plurality of colors, the first issuing step comprises determining image writing timing for a first color and issuing the image writing reference position signal for the first color, then determining image writing timing for a next color after lapse of a time period corresponding to one rotation of the image carrier later and issuing the image writing reference position signal for the next color, and when image formation is carried out for the plurality of colors, the second issuing step comprises determining the image writing timing for the first color with reference to the reference position of the image carrier detected in the reference position detecting step and issuing the image writing reference position signal for the first color, and then determining the image writing timing for the next color with reference to the reference position of the image carrier redetected in the reference position detecting step and issuing the image writing reference position signal for the next color.

More preferably, the image forming control method comprises a reference clock generating step of generating a reference clock signal, a reference clock counting step of counting time with reference to one period of the reference clock signal as a unit time, a circumference measuring step of measuring the circumference of the image carrier based on a time interval counted in the reference clock counting step based on the reference position detected in the reference position detecting step, a storage step of storing the circumference measured in the circumference measuring step, and a line number counting step of counting a number of lines with reference to one period of a laser beam detect signal in a main scanning direction as one line period.

More preferably, the reference clock signal has a period corresponding to a time period less than the one line period.

Still more preferably, the image forming control method comprises a conversion step of converting a count value, which has been counted in units of the reference clock signal in the circumference measuring step, the count value corresponding to the circumference of the image carrier, into a number of lines, and wherein the storage step comprises storing the number of lines converted in the conversion step.

Also preferably, the conversion step comprises converting the count value into the number of lines, by finely adjusting an integer part of a conversion result in accordance with a decimal part of the conversion result, and the storage step comprises storing a value of the integer part finely adjusted in the conversion step.

Still more preferably, the storage step comprises storing the number of lines, and the first issuing step comprises causing the line number counting step to count the number of lines stored in the storage step and determining issuing timing of the image writing reference position signal for the next color.

Still more preferably, the line number counting step comprises counting a predetermined number of lines corresponding to a time period from issuing of the image writing reference position signal for a final color to restart of conveying for a recording medium from a recording medium standby position located upstream of a position at which image formation is carried out.

Preferably, the selection step comprises selecting the signal issuing in the second issuing step when a processing speed at which image formation is carried out is changed during image formation, and selecting the signal issuing in the first issuing step when the processing speed is not changed during image formation.

Preferably, the image forming method is executed by an image forming apparatus selected from the group consisting of a copying machine, a printer, and a multifunction apparatus having a combination of functions of a copying machine and a printer.

According to the constructions of the first and second aspects of the present invention, image formation (processing from charging to fixing with exposure, developing, and transferring in between) can be carried out on a recording medium such as plain paper without increasing the FCOT as a time period from the start of image formation to discharging of a first recording medium for which image formation has been completed, and it is also possible to carry out optimal image formation on a recording medium, such as thick paper, for which the processing speed is reduced with no registration misalignment between the leading ends of toner images and the leading end of the recording medium.

The above and other objects, features, and advantages of the invention will become more apparent from the following detailed description taken in conjunction with the accompanying drawings.

BRIEF DESCRIPTION OF THE DRAWINGS

FIG. 2 is a block diagram showing the construction of a control unit of the image forming apparatus shown in. FIG. 1 and its related components;

FIG. 3 is a block diagram showing the detailed construction of a digital image processing section that forms a part of the control unit of the image forming apparatus;

DETAILED DESCRIPTION OF THE PREFERRED EMBODIMENTS

Figure 1:
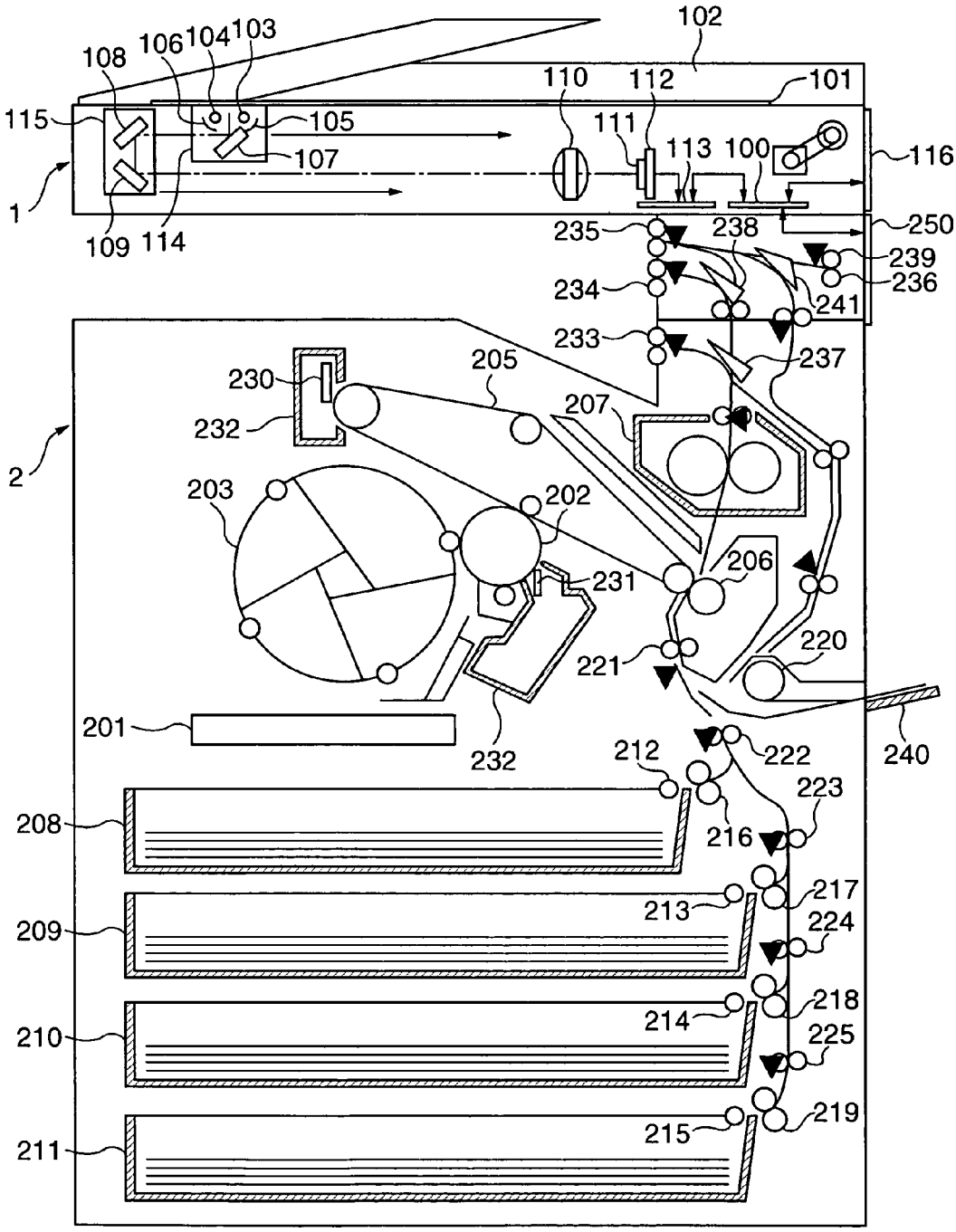
FIG. 1 is a schematic cross-sectional view showing the construction of an image forming apparatus according to an embodiment of the present invention.

The present invention will now be described in detail below with reference to the accompanying drawings showing a preferred embodiment thereof. In the drawings, elements and parts which are identical throughout the views are designated by identical reference numerals, and duplicate description thereof is omitted.

FIG. 1 is a schematic cross-sectional view showing the construction of an image forming apparatus according to an embodiment of the present invention.

The image forming apparatus according to the present embodiment is constructed as a copying machine that carries out full-color image formation using an electrophotographic method (laser beam method). This image forming apparatus is mainly comprised of a color reader section 1 including an original glass platen 101, an automatic original feeding device 102, a carriage 114, a carriage 115, a CCD (Charge Coupled Device) image sensor 111, a control unit 100, a digital image processing section 113, an external interface section 116, and others, and a color printer section 2 including a laser scanner 201, a photosensitive drum 202, developing devices 203 for respective colors, an intermediate transfer member 205, a secondary transfer roller 206, a fixing device 207, cassettes 208 to 211, a manual feed tray 240, a printer controller 250, various rollers, various flappers, and others.

First, the respective constructions of component parts of the color reader section 1 of the image forming apparatus will be described. An original to be copied is automatically fed to an original reading position on an upper surface of the original glass platen 101. The automatic original feeding device (auto document feeder or "ADF") 102 automatically feeds an original that has been set at an original stacking section, not shown, to the original reading position on the original glass platen 101. It should be noted that in place of the automatic original feeding device 102, it is possible to provide a mirrored pressing plate or a white pressing plate, not shown, at an upper part of the image forming apparatus, and, an original is manually placed at the original reading position on the original glass platen 101, and the original is read while it is pressed by the mirrored pressing plate or the white pressing plate.

The carriage 114 accommodates light sources 103 and 104, reflective shades 105 and 106, and a mirror 107. The light sources 103 and 104 illuminate the original and are implemented by halogen lamps, fluorescent lamps, xenon tube lamps, or the like. The reflective shades 105 and 106 converge the light emitted from the light sources 103 and 104 onto the original. The mirror 107 reflects light reflected off the original to a mirror 108. The carriage 115 accommodates the mirror 108 and a mirror 109. The mirrors 108 and 109 reflect light from the mirror 107 towards a lens 110. It should be noted that a moving mechanism, not shown, mechanically moves the carriage 114 at a speed v and the carriage 115 at a speed v/2 in a subscanning direction Y that is perpendicular to an electric scanning direction (main scanning direction X) of the CCD 111, to thereby scan the entire surface of the original.

The lens 110 converges reflected light or projected light from the original that has passed via the mirrors 107 to 109 onto the CCD image sensor (hereinafter referred to as the "CCD") 111. The CCD 111 carries out a photoelectric conversion that converts reflected light or projected light from the original into an electric signal. The CCD 111 is mounted on a substrate 112. The control unit 100 controls the entire image forming apparatus. The digital image processing section 113 is a printer processing section (reader/scanner controller) including component parts in a construction shown in FIG. 3, described later, excluding the CCD 111 and the external interface section 116 (that is, component parts numbered 502 to 516). The external interface section 116 acts as an interface for external apparatuses (i.e., other devices).

Figure 2:
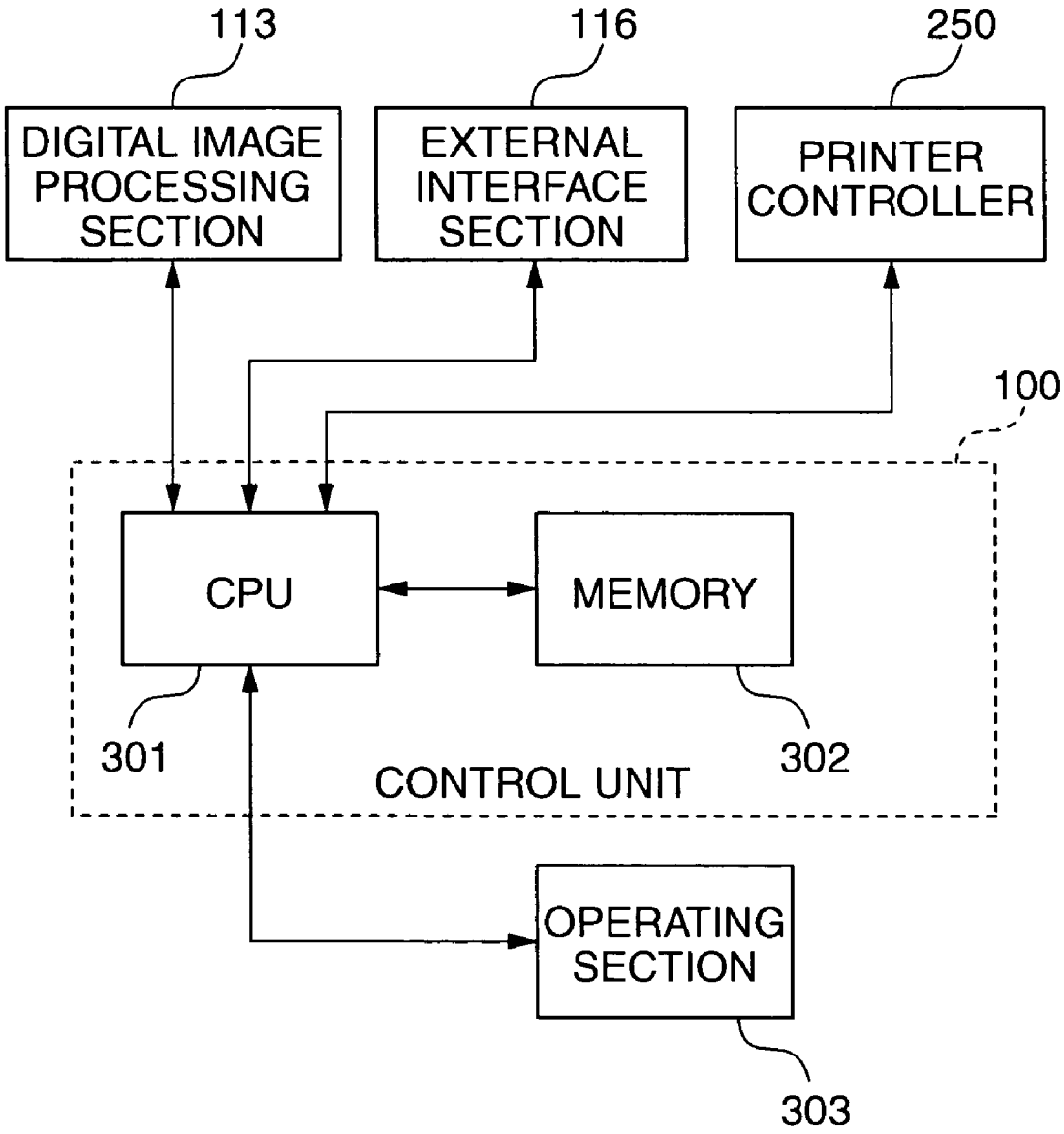

FIG. 2 is a block diagram showing the construction of the control unit 100 of the image forming apparatus shown in FIG. 1 and its related components.

The control unit 100 includes a CPU 301 and a memory 302. In FIG. 2, reference numeral 303 designates an operating section. The CPU 301 of the control unit 100 includes an interface that exchanges information with the digital image processing section 113 and the printer controller 250 to control these sections, and an interface that exchanges information with the operating section 303. The memory 302 stores programs executed by the CPU 301 and data. The operating section 303 is comprised of a liquid crystal display with a touch panel, for example, so as to enable an operator to input instructions for causing the image forming apparatus carry out predetermined processing and to provide the operator with information, warnings, and the like relating to the processing of the image forming apparatus, and is provided on a housing of the image forming apparatus.

FIG. 3 is a block diagram showing the detailed construction of the digital image processing section 113 of the image forming apparatus shown in FIG. 1.

The digital image processing section 113 includes a clamp-and-amp-and-sample/hold (S/H)-and-A/D section 502, a shading section 503, a connection-and-MTF correction-original detecting section 504, an input masking section 505, a selector 506, a color space compression-and-background removal-and-LOG conversion section 507, a delay section 508, a moiré removing section 509, a magnification processing section 510, a UCR-and-masking-and-black character reflecting section 511, a γ correction section 512, a filter section 513, a background removal section 514, a black character determining section 515, and a page memory section 516.

The original on the original glass platen 101 reflects light emitted from the light sources 103 and 104 and the reflected light is guided via the mirrors 107 to 109 and the lens 110 to the CCD 111 where the light is converted into an electric signal (analog image signal). Here, in the case where the CCD 111 is a color image sensor, the CCD 111 may be implemented by a single-line CCD where red (R), green (G), and blue (B) color filters are provided in a line in the order of red (R), green (G), and blue (B) or by a three-line CCD where a red (R) filter, a green (G) filter, and a blue (B) filter are arranged on separate CCDs. The filters may be provided on a chip, or may be in separate bodies from the CCD 111.

Next, the electric signal (analog image signal) mentioned above is inputted to the digital image processing section 113. In the clamp-and-amp-and-S/H-and-A/D section 502, the signal is sampled and held, a dark level of the analog image signal is clamped at a reference potential, the signal is amplified to a predetermined level (the order in which these processes are carried out is not limited to the stated order), and the signal is subjected to an A/D conversion into eight-bit digital signals (RGB signals) for R, G, and B, for example. Then, the digital signals (RGB signals) are subjected to shading correction and black correction by the shading section 503. After this, in the connection-and-MTF correction-original detecting section 504, connection processing is carried out as follows in the case where the CCD 111 is a three-line CCD. That is, since a reading position differs between the respective lines, delay amounts for the respective lines are adjusted in accordance with a reading speed to thereby correct read position timing for the digital signals so that the read positions are the same for the three lines. Further, in the connection-and-MTF correction-original detecting section 504, MTF (Modulation Transfer Function) correction is carried out to correct changes in an MTF for the reading due to the read speed and magnification, and original detection processing is carried out to detect the size of the original by scanning the original on the original glass platen 101.

Next, the input masking section 505 corrects the digital signals thus having the reading position timing corrected, for spectral characteristics of the CCD 111 and spectral characteristics of the light sources 103 and 104 and the mirrors reflective shades 105 and 106. Output signals from the input masking section 505 are inputted to a selector 506 that can switch between the signals from the input masking section 505 and signals from the external interface section 116. The signals outputted from the selector 506 are inputted to the color space compression-and-background removal-and-LOG conversion section 507 and the background removal section 514. Background removal correction are carried out on the signals inputted to the background removal section 514, and the resulting signals are inputted to the black character determining section 515 that determines whether characters in the original image are black characters, and generates a black character signal according to a result of reading the original.

The color space compression-and-background removal-and-LOG conversion section 507 to which the output signals of the selector 506 have also been inputted, carries out color space compression processing by determining whether the read image signals (RGB signals) are within a range that can be reproduced by the color printer section 2 and outputs the input signals as they are when the signals are in this range or amending the signals so as to be within the range that can be reproduced by the color printer section 2 when the signals are not in this range.

Further, the color space compression-and-background removal-and-LOG conversion section 507 carries out background removal processing to convert the RGB signals to YMC signals. Then, to correct timing with respect to the black character signal generated by the black character determining section 515, timing of the output signals of the color space compression-and-background removal-and-LOG conversion section 507 are adjusted by the delay section 508. The moiré removing section 509 removes moiré from the two kinds of signals outputted from the delay section 508 and the black character determining section 515, and the resulting signals are subjected to magnification/reduction processing in the main scanning direction by the magnification processing section 510.

Then, the signals subjected to magnification/reduction carried out by the magnification processing section 510 are delivered to the UCR-and-masking-and-black character reflecting section 511, where the signals are subjected to UCR (Under Color Removal) processing to generate YMCK signals from the YMC signals, and then subjected to masking processing to correct the YMCK signals into suitable signals for output by the color printer section 2, and a determination result signal generated by the black character determining section 515 mentioned above is fed back to the YMCK signals. The signals processed by the UCR-and-masking-and-black character reflecting section 511 are subjected to density adjustment by the γ correction section 512, and then subjected to smoothing processing or edge processing by the filter section 513. The processed signals are stored in the page memory section 516 and are outputted in image forming timing to the color printer section 2.

Referring again to FIG. 1, the printer controller 250, which is disposed on the color printer section 2, receives control signals outputted from the CPU 301 inside the control unit 100 that is disposed in the color reader section 1 and controls the entire image forming apparatus. The control unit 100 causes the color reader section 1 to carry out image reading control as described above, temporarily stores read image data in the memory 302 inside the control unit 100, and operates in accordance with a reference timing signal from the printer controller 250 to transmit image data in the memory 302 as image data signals in timing synchronous with a video clock.

The color printer section 2 operates as described below based on a control signal from the printer controller 250.

The laser scanner 201 scans laser light corresponding to the image data signals in the main scanning direction using a polygon mirror so as to expose the photosensitive drum 202. With clockwise rotation of the photosensitive drum 202, a latent image thus formed on the photosensitive drum 202 reaches a position facing a position of a developing sleeve surface of a four-color developing rotary for one color out of the four colors, the rotary being equipped with the developing devices 203 for respective colors. An amount of toner corresponding to the potential present between the surface of the photosensitive drum 202 on which the latent image has been formed and the developing sleeve surface to which a developing bias has been applied is jetted from one of the developing devices 203 to the surface of the photosensitive drum 202 to develop the latent image on the surface of the photosensitive drum 202.

Then, as the photosensitive drum 202 rotates in the clockwise direction, the toner image thus formed on the surface of the photosensitive drum 202 is primarily transferred onto the intermediate transfer member 205 that rotates in a counterclockwise direction. In the case of black monochrome images, toner images are primarily transferred onto the intermediate transfer member 205 at predetermined time intervals. In the case of full-color images, latent images corresponding to the respective colors on the photosensitive drum 202 are developed by successively positioning the images at the developing sleeve surfaces of the developing rotary for the respective colors and the toner images on the photosensitive drum 202 are primarily transferred onto the intermediate transfer member 205. After four rotations of the intermediate transfer member 205, that is, when primary transfer has been carried out for four colors, the primary transfer for a full-color image is completed.

Next, how recording sheets are fed will be described. In the case of automatic feeding, a recording sheet is picked up from a cassette (selected one of an upper cassette 208, a lower cassette 209, a third cassette 210, and a fourth cassette 211) by a pickup roller (one of pickup rollers 212, 213, 214, and 215) provided for the cassette and is conveyed by a feed roller (one of feed rollers 216, 217, 218, and 219) provided for the cassette. Then, the recording sheet is conveyed by vertical path conveying rollers 222, 223, 224, and 225 to a registration roller 221 where the recording sheet is put into a standby state. In the case of a manual feed, a recording sheet stacked on the manual feed tray 240 is conveyed by a manual feed roller 220 to the registration roller 221 to be put into the standby state. After this, regardless of whether automatic feeding or manual feeding is performed, the recording sheet is conveyed to a space between the intermediate transfer member 205 and the secondary transfer roller 206 in timing in which the primary transfer onto the intermediate transfer member 205 has been completed.

Then, the recording sheet is conveyed towards the fixing device while it is held between the secondary transfer roller 206 and the intermediate transfer member 205 and is pressed onto the intermediate transfer member 205 so that the toner image on the intermediate transfer member 205 is secondarily transferred. The toner image transferred onto the recording sheet is fixed on the recording sheet through the application of heat and pressure by the fixing device comprised of a fixing roller and a pressing roller. It should be noted that remaining toner on the intermediate transfer member 205 that is not transferred and remains on the intermediate transfer member 205 is removed from the surface of the intermediate transfer member 205 by wiping away the remaining toner from the surface of the intermediate transfer member 205 by means of an intermediate transfer cleaning blade 230 disposed for contact with and separation from the surface of the intermediate transfer member 205, so that cleaning is performed by post-processing control in the latter half of an image forming sequence.

Inside a photosensitive drum unit that includes the photosensitive drum 202, remaining toner is wiped away from the surface of the photosensitive drum 202 by the cleaning blade 230 and is conveyed to a waste toner box 232 provided integrally in the photosensitive drum unit. In addition, other remaining toner with a positive or negative polarity that is unexpectedly attached to the surface of the secondary transfer roller 206 can be attached to the intermediate transfer member 205 by alternately applying a secondary transfer forward bias and a secondary transfer reverse bias to the intermediate transfer member 205. By wiping off the remaining toner with the intermediate transfer cleaning blade 230, the toner can be completely cleaned off, thereby completing the post-processing control.

The recording sheet to which the image has been fixed is discharged according to any of a first discharge method, a second discharge method, and a third discharge method. That is, in the case where the recording sheet is discharged according to the first discharge method, a first discharge flapper 237 is switched to the direction of a first discharge roller 233 and the recording sheet is discharged. In the case where the recording sheet is discharged according to the second discharge method, the first discharge flapper 237 and a second discharge flapper 238 are switched to the direction of a second discharge roller 234 and the recording sheet is discharged. In the case where the recording sheet is discharged according to the third discharge method, in order to have the recording sheet inverted by an inverting roller 235, the first discharge flapper 237 and the second discharge flapper 238 are switched to the direction of the inverting roller 235 and the recording sheet is inverted by the inverting roller 235. After inversion at the inverting roller 235, a third discharge flapper 241 is switched to the direction of a third discharge roller 236, and the recording sheet is discharged.

In the case of double-sided discharging where the recording sheet is discharged after images are formed on both sides, in the same way as the third discharge method, a recording sheet that has had an image formed on a first side (one side) is inverted by the inverting roller 235 the third discharge flapper 241 is switched to the direction of a two-sided unit, and the recording sheet is conveyed. Upon the lapse of a predetermined time period after a two-sided sensor has detected the recording sheet, conveying of the recording sheet is temporarily stopped, and when image preparations are completed again, the recording sheet is refed to the space between the intermediate transfer member 205 and the secondary transfer roller 206, and image formation is carried out on a second side (the other side) of the recording sheet. After this, the recording sheet on both sides of which image formation has been carried out is discharged according to one of the first discharge method, the second discharge method, and the third discharge method described above.

Next, image formation using a result of circumference detection for the intermediate transfer member 205 will be described.

Figure 4:
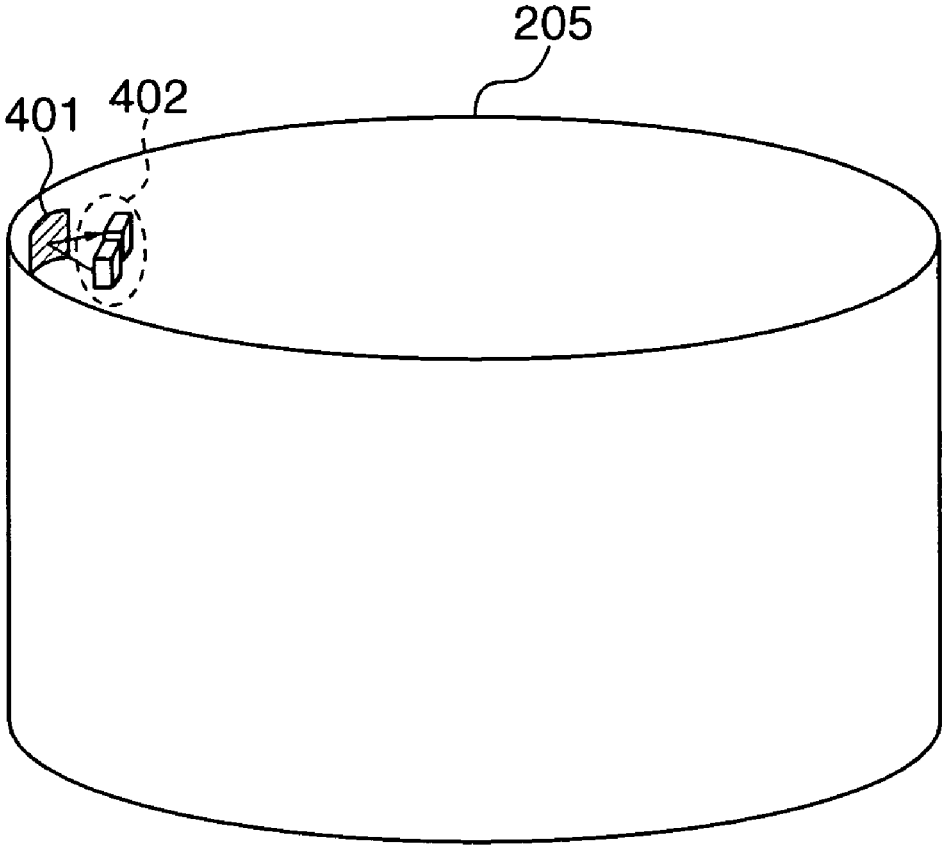
FIG. 4 is a view schematically showing the construction of an intermediate transfer member of the image forming apparatus.

FIG. 4 is a view schematically showing the construction of the intermediate transfer member 205 of the image forming apparatus. The intermediate transfer member 205 is formed of a belt-like member and has a marking 401 attached to an inner surface thereof which is used to determine a reference position (home position) that is an image writing reference for the intermediate transfer member 205. Also, at a position slightly away from an inner surface of the intermediate transfer member 205, a marking-detection home position sensor 402 is disposed to detect an edge of the marking 401 attached to the intermediate transfer member 205.

Figure 5:
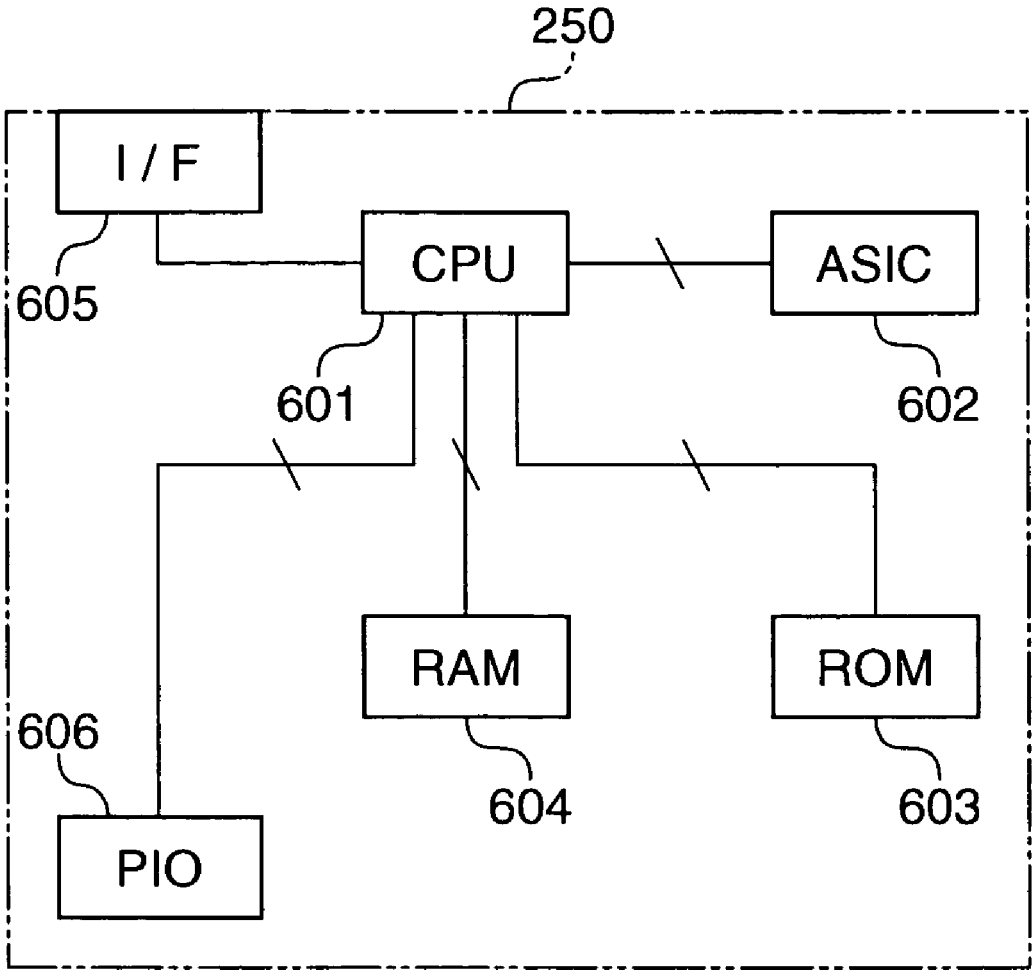
FIG. 5 is a block diagram schematically showing the construction of a printer controller of the image forming apparatus.

FIG. 5 is a block diagram schematically showing the construction of the printer controller 250 of the image forming apparatus.

The printer controller 250 is comprised of a printer section control CPU 601, an ASIC (Application Specific Integrated Circuit) 602, a ROM 603, a RAM 604, a communication interface 605, and a PIO (Parallel Input/Output) 606. The printer section control CPU 601 controls various component parts inside the printer controller 250 and also various component parts of the color printer section 2 based on control software stored in the ROM 603. The ASIC 602 executes a program for realizing the main functions of the color printer section 2, and includes a counter and a register, not shown. The ROM 603 stores control software of the printer controller 250. The RAM 604 is used as a work memory for the control software of the printer controller 250. The communication interface 605 is an interface in charge of communication with the control unit 100 that controls the entire image forming apparatus. The PIO 606 is an I/O port for communication between the printer controller 250 and other control blocks.

Next, an example of control carried out by the image forming apparatus according to the present embodiment will be described with reference to FIGS. 6 to 9.

Figure 9:
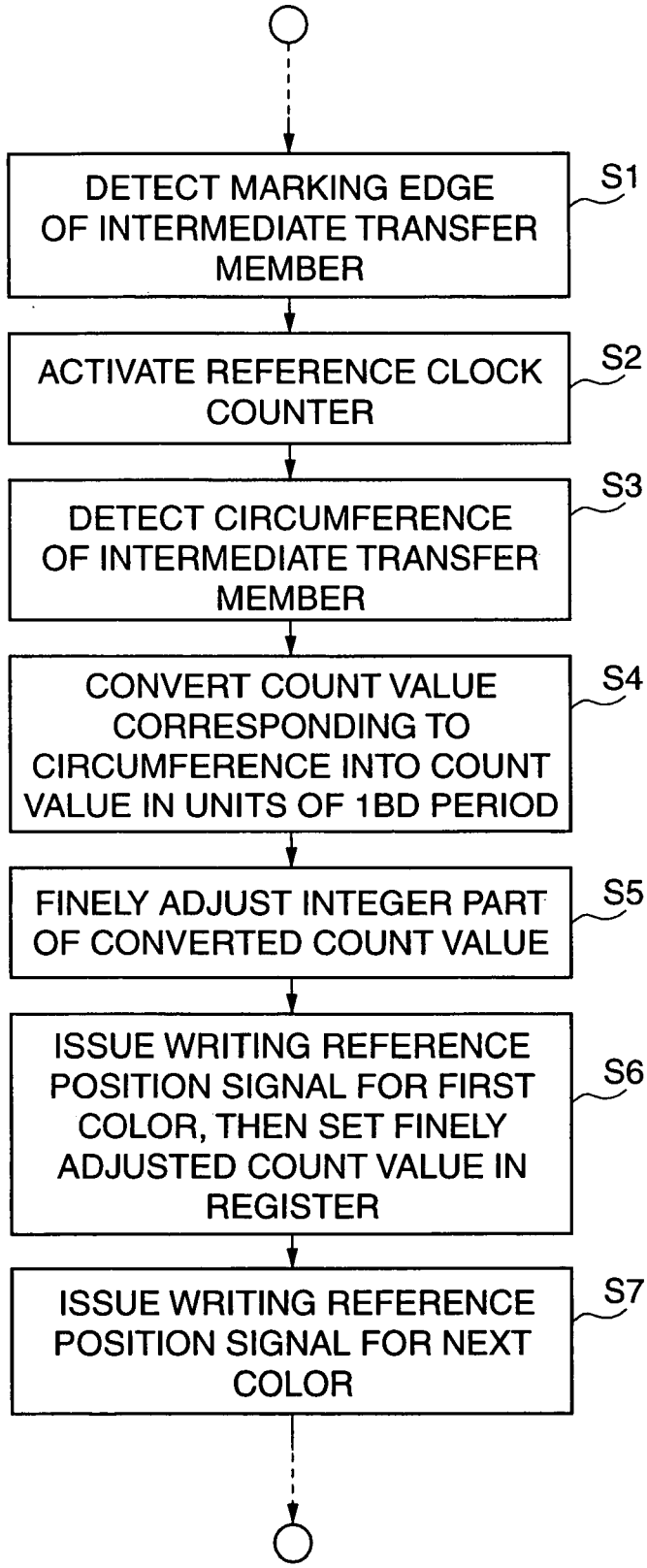
FIG. 9 is a flowchart showing an image writing reference position signal issuing process carried out by the image forming apparatus.

FIG. 9 is a flowchart showing an image writing reference position signal issuing process carried out by the image forming apparatus.

An edge detection signal obtained by edge detection for the marking 401 on the intermediate transfer member 205 by the home position sensor 402 shown in FIG. 4 (step S1), is inputted to the printer section control CPU 601 shown in FIG. 5 as an interrupt signal and is also inputted to the ASIC 602. When the edge detection signal is inputted to the ASIC 602, a counter, not shown, inside the ASIC 602 that counts reference clock signals generated inside the ASIC 602 within a 1BD (Beam Detect: a laser beam detection signal in the main scanning direction) period is activated (step S2), and the count value of reference clock signals is latched in a specified register, not shown, upon input of the next edge detection signal.

In the case when only one marking 401 is attached to the intermediate transfer member 205, at a time point when the marking 401 is detected again following one detection of the marking 401 by the home position sensor 402, the circumference, i.e., the length in the circumferential direction, of the intermediate transfer member 205 is detected by the ASIC 602 (step S3). In the case where a plurality of markings 401 are attached to the intermediate transfer member 205, at a time point when a number of markings 401 corresponding to one rotation of the intermediate transfer member 205 have been detected, the circumference of the intermediate transfer member 205 is detected by the ASIC 602 by accumulating the count number latched in the register (step S3). The printer section control CPU 601 calculates a count value, which is counted for every reference clock signal and latched and corresponds to the circumference of the intermediate transfer member 205, per 1BD period.

Here, the reference clock signals are issued by the ASIC 602 as a reference for counting, and have a duration that is set to a duration less than one line period at the maximum. One period of the reference clock signal is set as one unit time, and a desired time period is counted by a counter, not shown, of the ASIC 602 in units of the reference clock signals.

Figure 6:
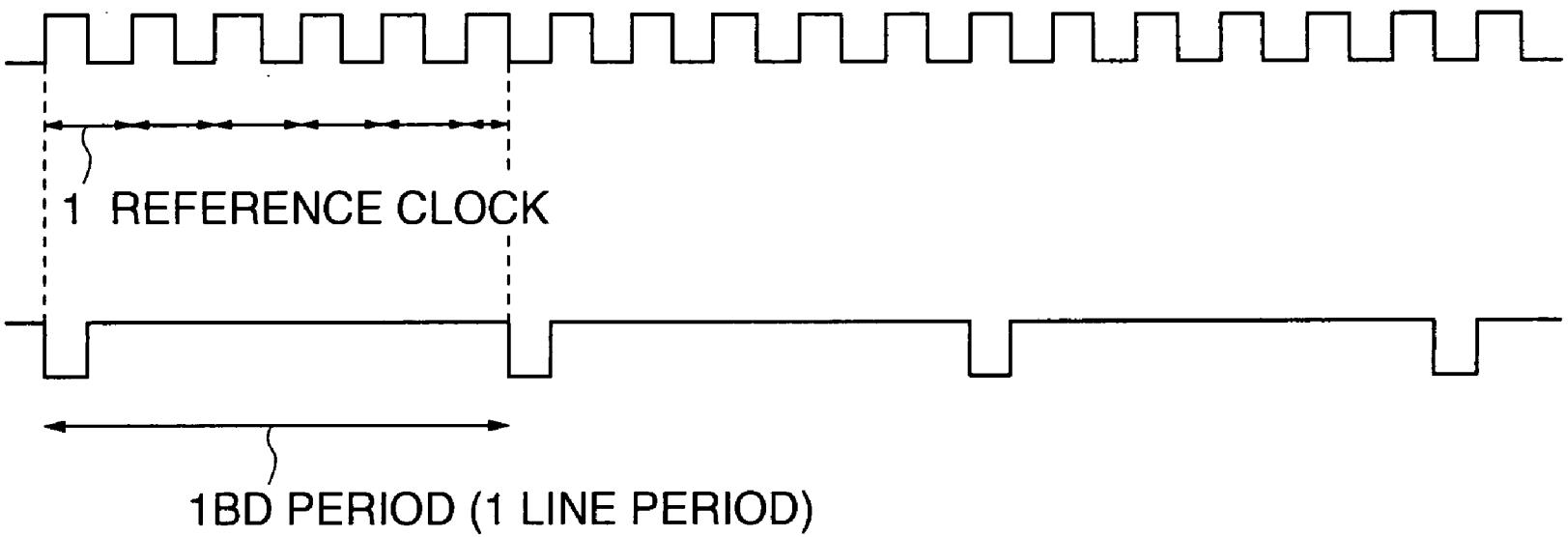
FIG. 6 is a timing chart showing the timing relationship between a 1BD period and reference clock signal periods.
Figure 7:
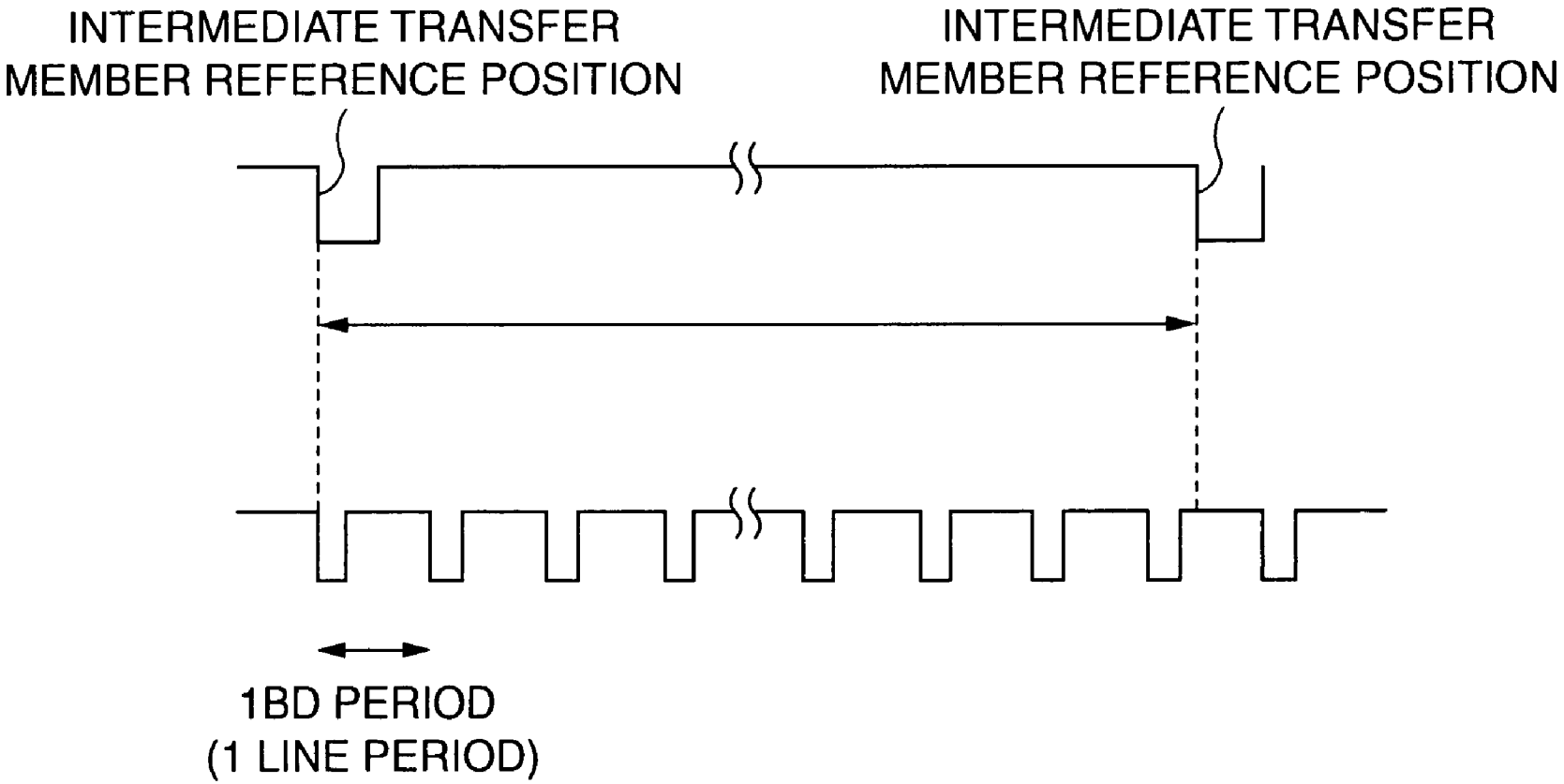
FIG. 7 is a timing chart showing the timing relationship between a BD period signal and a detected intermediate transfer member reference position when detecting the circumference of the intermediate transfer member 205 shown in FIG. 4.
Figure 8:
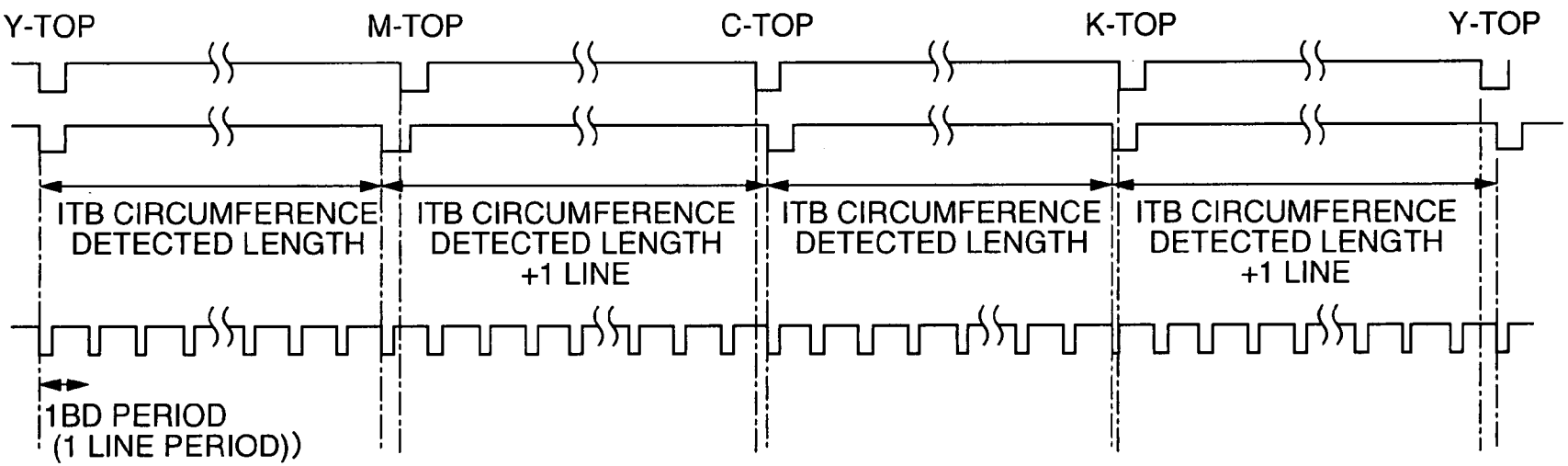
FIG. 8 is a timing chart showing the timing of issuing of an image writing reference position signal when correction control is provided for the detection of the circumference of the intermediate transfer member.

FIG. 6 is a timing chart showing the timing relationship between the reference clock signals and the 1BD period signals, FIG. 7 is a timing chart showing the timing relationship between a BD period signal and a detected intermediate transfer member reference position when detecting the circumference of the intermediate transfer member 205 shown in FIG. 4, and FIG. 8 is a timing chart showing the timing of issuing of an image writing reference position signal when correction control is provided for the detection of the circumference of the intermediate transfer member 205.

The example shown in FIG. 6 shows that approximately 5.5 reference clock periods is equal to 1BD period. Using this relationship, the printer section control CPU 601 converts the count value latched in the register of the ASIC 602 into a count value in units of 1BD period (i.e., single line)(step S4). An integer part of the count value resulting from the conversion is then finely adjusted in accordance with a decimal part of the converted count value obtained at the same time (step S5).

In the case where there is only one marking 401 attached to the intermediate transfer member 205 as shown in FIG. 4, in detection of the circumference of the intermediate transfer member 205, the marking 401 (intermediate transfer member reference position) is not always detected in timing corresponding to an integer multiple of the period of the BD period signal as shown in FIG. 7, and therefore the integer part of the count value obtained by the conversion described above needs to be finely adjusted by adding "+1", "+0", or "−1" depending on the value of the decimal part obtained by the same calculation.

In the ASIC 602 of the present embodiment, after an image writing reference position (TOP) signal for a first color (Y) on the intermediate transfer member 205 has been issued, once the count value after the fine adjustment has been set in a setting register (step S6), a number of BD period signals equivalent to the set count value are counted, and after the counting an image writing reference position (TOP) signal for the next color is issued (step S7) (see FIG. 8). It should be noted that in FIG. 8, symbol "ITB" designates the intermediate transfer member (belt), and symbols "Y-TOP", "M-TOP", "C-TOP", and "K-TOP" designate the image writing reference position signals for the respective colors, yellow, magenta, cyan, and black. The image writing reference position signal issuing function for the respective colors of the ASIC 602 is used to detect in advance the circumference of the intermediate transfer member 205, the count value counted in units of reference clock signals is converted into units of 1BD period, the conversion result is stored in a memory such as the RAM 604, and during image formation the conversion result stored in the memory is used so that it is possible to form full-color images regardless of the marking position on the intermediate transfer member 205.

Next, image formation using the reference position obtained by detection of the marking position on the intermediate transfer member 205 will be described.

In the image forming apparatus according to the present embodiment, by detecting the edge of the marking 401 of the intermediate transfer member 205 as described above once per rotation of the intermediate transfer member 205 for a total of four rotations corresponding to four colors, and inputting an interrupt signal to the printer section control CPU 601 every time the marking edge is detected, to cause the ASIC 602 to issue image writing reference position signals for the respective colors, yellow, magenta, cyan, and black, to thereby make it possible to form an image with no registration misalignment between leading ends of toner images and the leading end of the recording sheet.

In the image forming apparatus according to the present embodiment, in order to correctly carry out image formation with no registration misalignment between the leading ends of the toner images and the leading end of the recording sheet, registration roller release timing ("registration ON timing") in which the recording sheet is released from the registration roller 221 (i.e., the recording sheet is released from the standby state and conveying is recommenced) is used such that a number of lines corresponding to a time period from issuing of a toner image writing reference position signal for the final color to the registration ON timing is set in the ASIC 602. In the ASIC 602, the set line number value is counted in units of BD period signals. By thus counting BD signals that are very accurate, the registration ON timing is accurately determined.

In the registration ON timing, the ASIC 602 inputs an interrupt signal to the printer section control CPU 601. Upon receiving the interrupt signal in the registration ON timing, the printer section control CPU 601 releases the registration roller 221 from a registration roller position at which the registration roller 221 has been temporarily stopped for skew correction (a correction operation for skewing of the recording sheet by having a leading end of the recording sheet abutting on the registration roller 221) to start refeeding of the recording sheet, thereby realizing optimal secondary transfer control.

In carrying out image formation on a recording sheet such as thick paper and an OHP sheet, an image forming operation is carried out at a processing speed (rotational speed of the photosensitive drum) of 1/1 up to image formation on the intermediate transfer member 205 (primary transfer) and the fixing speed is reduced when the secondary transfer onto the recording sheet and fixing are carried out. By doing so, in the image forming apparatus according to the present embodiment, image formation onto the intermediate transfer member 205 is carried out at the processing speed of 1/1, which can dispense with a complicated hardware construction for thinning out image data in laser-exposing the photosensitive drum 202.

However, since in the present embodiment correct registration is realized by determining the registration ON timing based on the image writing reference positions, if a motor speed reducing process is carried out to lower the processing speed during the image forming process at the secondary transfer and subsequent steps, it is difficult to grasp time due to the motor speed reducing process, so that the registration ON timing cannot be correctly set based on the timing of issuing of the toner image writing reference position signals.

To overcome this, in the image forming apparatus according to the present embodiment, image formation is carried out using the reference position of the intermediate transfer member 205. Specifically, when image formation is carried out on a recording sheet such as thick paper or an OHP sheet, toner image formation is carried out with edge detection of the marking 401 on the intermediate transfer member 205 as a reference for image writing, and the edge of the marking 401 is redetected after the processing speed has been reduced. By doing so, the correct toner image top or leading end position can be found even after the processing speed has been reduced, so that the secondary transfer and fixing control can be optimally carried out with no registration misalignment between the leading ends of the toner images and the leading end of the recording sheet.

Here, the operating section 303 of the image forming apparatus can freely select an image forming method out of "image formation using the detected circumference of the intermediate transfer member 205" described above and "image formation using the reference position found by detecting the marking position on the intermediate transfer member 205" described above.

"Image formation using the reference position found by detecting the marking position on the intermediate transfer member 205" can be selected by the operating section 303 of the image forming apparatus in the case where the processing speed is changed during image formation, while "image formation using the detected circumference of the intermediate transfer member 205" can be selected in the case where the processing speed is not changed during image formation. Based on such setting from the operating section 303, the ASIC 602 carries out the control described above under the control of the printer section control CPU 601.

As described above, according to the present embodiment, in the image forming apparatus in which image formation is carried out by primarily transferring a toner image on the photosensitive drum 202 onto the intermediate transfer member 205 and then secondarily transferring the toner image on the intermediate transfer member 205 onto the recording sheet, the ASIC 602 of the printer controller 250 selectively switches, based on a setting from the operating section 303, between (i) image formation carried out by issuing an image writing reference position signal for starting image formation based on the circumference of the intermediate transfer member 205 (image formation using the detected circumference of the intermediate transfer member 205) and (ii) image formation carried out by issuing an image writing reference position signal for starting image formation based on a detected reference position on the intermediate transfer member 205 (image formation using a reference position found by detecting a marking position on the intermediate transfer member 205).

As a result, it is possible to provide an image forming apparatus that can carry out image formation on plain paper without increasing the FCOT (First Copy Out Time), i.e., a time period from the start of image formation (processing from charging to fixing with exposure, developing, and transferring in between) to discharging of a first recording sheet for which image formation has been completed, and can also carry out optimal image formation on a recording sheet, such as thick paper, for which the processing speed is reduced, with no registration misalignment between the leading end of the toner image and the leading end of the recording sheet.

It may be configured such that the selective switching between the image formation using the detected circumference of the intermediate transfer member 205 and the image formation using a reference position found by detecting a marking position on the intermediate transfer member 205 can be automatically carried out based on a detected type of the recording sheet such as plain paper or thick paper or an OHP sheet.

The present invention is not limited to the above described embodiment and can be applied to any other construction that can achieve the functions described in the appended claims or the functions of the construction of the above described embodiment. Although an image forming method is freely selected out of "image formation using the detected circumference of the intermediate transfer member 205" and "image formation using a reference position by detecting a marking position on the intermediate transfer member 205" in the above embodiment, a variety of methods may be selected. For example, the former image forming method may be carried out in the case where an instruction not to change the processing speed during image formation has been received from the operating section 303 and the latter image forming method may be carried out in the case where an instruction to change the processing speed during image formation has been received from the operating section 303. As another example, dedicated keys corresponding respectively to the former and latter image forming methods may be provided on the operating section 303, and when one of the keys has been pressed, the image forming method corresponding to the pressed key may be carried out.

Although the above described embodiment is directed to an example where the printer controller 250 of the image forming apparatus has the construction shown in FIG. 5, the present invention is not limited to this construction. For example, instead of providing the CPU 601 and the ASIC 602 separately, other constructions, such as a construction with a single block having the functions of the CPU 601 and the ASIC 602, may be used as desired without departing from the scope of the present invention.

Also, although the above described embodiment is directed to an example where the image forming apparatus is a copying machine that carries out image formation using the electrophotographic method, the present invention is not limited to this and can be applied to a multifunction apparatus or a printer that carries out image formation according to the electrophotographic method.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read out from the storage medium realizes the functions of the embodiment described above, and hence the program code and the storage medium in which the program code is stored constitute the present invention.

Examples of the storage medium for supplying the program code include a floppy (registered trademark) disk, a hard disk, a magneto-optical disk, a CD-ROM, a CD-R, a CD-RW, a DVD-ROM, a DVD-RAM, a DVD-RW, a DVD+RW, a magnetic tape, a nonvolatile memory card, and a ROM.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium, into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. An image forming apparatus comprising:

a rotatively driven image carrier;

a primary transfer device that primarily transfers an image onto said image carrier;

a secondary transfer device that secondarily transfers the image on said image carrier onto a recording medium; and a controller, wherein said controller issues a first image writing reference position signal for starting image formation based on a circumference that is a length of said image carrier in a direction of rotation thereof, wherein said controller issues a second image writing reference position signal for starting image formation based on a detected reference position on the image carrier, and wherein said controller selectively switches between the first and second image writing reference position signals;

a reference position detecting device that detects the reference position on said image carrier by detecting a marking attached to said image carrier;

a reference clock generating device that generates a reference clock signal;

a reference clock counting device that counts time with reference to one period of the reference clock signal as a unit time;

a circumference measuring device that measures the circumference of said image carrier based on a time interval counted by said reference clock counting device based on the reference position detected by said reference position detecting device;

a storage device that stores the circumference measured by said circumference measuring device;

a line number counting device that counts a number of lines with reference to one period of a laser beam detect signal in a main scanning direction as one line period; and a conversion device that converts a count value, which has been counted in units of the reference clock signal by said circumference measuring device, the count value corresponding to the circumference of said image carrier, into a number of lines, and wherein said storage device stores the number of lines converted by said conversion device, wherein when image formation is carried out for a plurality of colors, said controller determines image writing timing for a first color and issues the first image writing reference position signal for the first color, and then determines the image writing timing for a next color after lapse of a time period corresponding to one rotation of said image carrier later and issues the first image writing reference position signal for the next color, wherein when image formation is carried out for the plurality of colors, said controller determines the image writing timing for the first color with reference to the reference position of said image carrier detected by said reference position detecting device and issues the second image writing reference position signal for the first color, and then determines the image writing timing for the next color with reference to the reference position of said image carrier redetected by said reference position detecting device and issues the second image writing reference position signal for the next color, and wherein said conversion device converts the count value into the number of lines, by finely adjusting an integer part of a conversion result in accordance with a decimal part of the conversion result, and said storage device stores a value of the integer part finely adjusted by said conversion device.

2. An image forming apparatus comprising:

a rotatively driven image carrier;

a primary transfer device that primarily transfers an image onto said image carrier;

a secondary transfer device that secondarily transfers the image on said image carrier onto a recording medium; and a controller, wherein said controller issues a first image writing reference position signal for starting image formation based on a circumference that is a length of said image carrier in a direction of rotation thereof, wherein said controller issues a second image writing reference position signal for starting image formation based on a detected reference position on the image carrier, wherein said controller selectively switches between the first and second image writing reference position signals, wherein said controller selects the second image writing reference position signal when a processing speed at which image formation is carried out is changed during image formation, and selects the first image writing reference signal when the processing speed is not changed during image formation.

3. An image forming control method executed by an image forming apparatus that carries out image formation by primarily transferring an image onto a rotatively driven image carrier and then secondarily transferring the image on the image carrier onto a recording medium, the method comprising:

a first issuing step of issuing a first image writing reference position signal for starting image formation based on a circumference that is a length of the image carrier in a direction of rotation;

a second issuing step of issuing a second image writing reference position signal for starting image formation based on a detected reference position on the image carrier;

a selection step of selectively switching between the first and second image writing reference position signals; and a reference position detecting step of detecting the reference position on the image carrier by detecting a marking attached to the image carrier;

a reference clock generating step of generating a reference clock signal;

a reference clock counting step of counting time with reference to one period of the reference clock signal as a unit time;

a circumference measuring step of measuring the circumference of the image carrier based on a time interval counted in said reference clock counting step based on the reference position detected in said reference position detecting step;

a storage step of storing the circumference measured in said circumference measuring step;

a line number counting step of counting a number of lines with reference to one period of a laser beam detect signal in a main scanning direction as one line period; and a conversion step of converting a count value, which has been counted in units of the reference clock signal in said circumference measuring step, the count value corresponding to the circumference of the image carrier, into a number of lines, wherein said storage step comprises storing the number of lines converted in said conversion step, wherein when image formation is carried out for a plurality of colors, said first issuing step comprises determining image writing timing for a first color and issuing the first image writing reference position signal for the first color, then determining image writing timing for a next color after lapse of a time period corresponding to one rotation of the image carrier later and issuing the first image writing reference position signal for the next color, wherein when image formation is carried out for the plurality of colors, said second issuing step comprises determining the image writing timing for the first color with reference to the reference position of the image carrier detected in said reference position detecting step and issuing the second image writing reference position signal for the first color, and then determining the image writing timing for the next color with reference to the reference position of the image carrier redetected in said reference position detecting step and issuing the second image writing reference position signal for the next color, wherein said conversion step comprises converting the count value into the number of lines, by finely adjusting an integer part of a conversion result in accordance with a decimal part of the conversion result, and said storage step comprises storing a value of the integer part finely adjusted in said conversion step.

4. An image forming control method executed by an image forming apparatus that carries out image formation by primarily transferring an image onto a rotatively driven image carrier and then secondarily transferring the image on the image carrier onto a recording medium, the method comprising:

a first issuing step of issuing a first image writing reference position signal for starting image formation based on a circumference that is a length of the image carrier in a direction of rotation;

a second issuing step of issuing a second image writing reference position signal for starting image formation based on a detected reference position on the image carrier; and a selection step of selectively switching between the first and second image writing reference position signals, wherein said selection step comprises selecting the second image writing reference position signal when a processing speed at which image formation is carried out is changed during image formation, and selecting the first image writing reference position signal when the processing speed is not changed during image formation.

* * * * *